US006910236B2

(12) United States Patent
René

(10) Patent No.: US 6,910,236 B2
(45) Date of Patent: Jun. 28, 2005

(54) MATTRESS LEG REST SECTION FOR AN ARTICULATABLE BED CONVERTIBLE TO A CHAIR POSITION

(76) Inventor: Pierre René, 2870, Les 40, Nicolet, Québec (CA), J3T 1M8

( * ) Notice: Subject to any disclaimer, the term of this patent is extended or adjusted under 35 U.S.C. 154(b) by 0 days.

(21) Appl. No.: 10/667,438

(22) Filed: Sep. 23, 2003

(65) Prior Publication Data

US 2004/0250349 A1 Dec. 16, 2004

(30) Foreign Application Priority Data

Jun. 11, 2003 (CA) ..... 2431805

(51) Int. Cl.[7] ..... A64G 7/00
(52) U.S. Cl. ..... 5/624; 5/618; 5/651; 5/184; 5/713
(58) Field of Search ..... 5/53.1, 618, 624, 5/648–651, 181, 184

(56) References Cited

U.S. PATENT DOCUMENTS 6,141,806 A 11/2000 Bobey et al.
6,212,714 B1 * 4/2001 Allen et al. ..... 5/624
6,427,264 B1 8/2002 Metz et al.

* cited by examiner

*Primary Examiner*—Heather Shackelford
*Assistant Examiner*—Fredrick Conley
(74) *Attorney, Agent, or Firm*—Ogilvy Renault; Guy J. Houle

(57) ABSTRACT

An articulated bed convertible to a chair position is described. The bed comprises a mattress formed by a backrest section, a seat rest section and a leg rest section. The mattress backrest section and seat rest section are secured to a support frame. Articulating linkages are secured to the frame to articulate the sections. The support frame is elevated from a floor surface by a frame assembly having legs or casters to engage with a floor surface. The leg rest section of the mattress is secured to a retractable support frame. The mattress has at least a compressible section formed of compressible material. Compressible interconnecting members compress the compressible material to shorten the length of the compressible section. The compressible material is restrained as it is compressed and decompressed when the support frames are displaced from a horizontal position to an articulated chair position.

25 Claims, 4 Drawing Sheets

MATTRESS LEG REST SECTION FOR AN ARTICULATABLE BED CONVERTIBLE TO A CHAIR POSITION

TECHNICAL FIELD

The present invention relates to a mattress leg rest section for use with an articulatable bed which is convertible to a chair position and wherein the mattress leg rest section is made of compressible material secured to a retractable framework.

BACKGROUND ART

It is known to construct articulatable beds which can be convertible to a chair position and this is particularly so with respect to hospital beds. For example, such a bed is described in U.S. Pat. No. 6,427,264. Reference is also made to U.S. Pat. No. 6,141,806 which relates to a bariatric bed and in both these patents the leg section of the bed is compressible by removing air from an extendible cushion. When the bed is moved to a seating position it is necessary to compress the leg rest section and this is achieved by providing an inflatable bag which is restrained and which is extendible by pumping air in the bag and compressible by releasing air from the bag. Such extendible leg rest sections have not functioned adequately and are problematic. For example, they require an air compressor and control devices for admitting and releasing air from the inflatable bag. This equipment is costly and requires extra space for mounting under the bed. It is also noisy. Also, the bag does not provide a solid support surface as any load on the bag displaces air and makes the support surface unstable. These bags can also be punctured and they don't offer safety features which are paramount with hospital beds. These bags also often need to be adjusted by an operator. With this type of bed construction it is not possible to provide a mattress wherein all the mattress sections are located in a single fabric envelope, due to the compression of the inflatable bag when air is released.

SUMMARY OF INVENTION

It is a feature of the present invention to provide a mattress leg rest section for use with an articulated bed convertible to a chair position and which substantially overcomes the above-mentioned disadvantages of the prior art.

It is a further feature of the present invention to provide a mattress leg rest section which is compressible and which offers a rigid support surface when in an extended position or a compressed position and wherein all of the mattress sections can be contained in a single envelope.

Another feature of the present invention is to provide a compressible mattress formed from a high density soft foam piece material having an undulated surface section which is compressible and wherein the foam piece is restrained during compression and decompression.

According to the above features, from a broad aspect, the present invention provides a mattress leg rest section for use with an articulated bed convertible to a chair position. The mattress leg section comprises at least a compressible section formed of compressible material and having an undulated surface section defining peaks and valleys formations dimensioned such as to be compressed by compressible interconnecting means to cause the peaks formations to be displaced closer to one another within the valleys formations to shorten the mattress leg rest section.

According to a still further broad aspect of the present invention there is provided an articulated bed convertible to a chair position. The bed comprises a mattress formed of sections including a leg rest section. The mattress sections are secured respective to support frames. Articulating linkage means is provided to articulate the support frames. The leg rest section of the mattress is secured to a retractable support frame. Means is provided to support the support frames elevated from a floor surface. The mattress has at least a compressible section thereof formed of compressible material. Compressible interconnecting means is provided to compress the compressible material to shorten the length of the compressible section. Restraining means is provided to restrain the compressible material as it is compressed and decompressed when the support frames are displaced from a horizontal position to an articulated chair position and vice versa.

BRIEF DESCRIPTION OF DRAWINGS

A preferred embodiment of the present invention will now be described with reference to the accompanying drawings in which.

DESCRIPTION OF PREFERRED EMBODIMENTS

Figure 3:
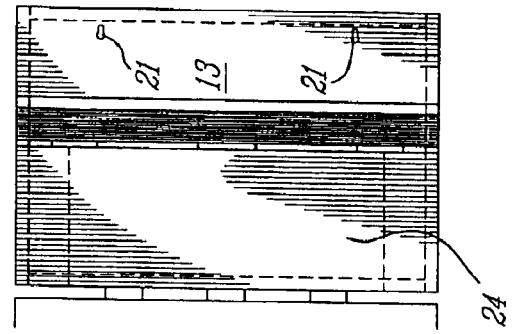
FIG. 3 is a fragmented plan view showing the retractable leg rest support frame in a retracted position whereas in FIG. 1 it is illustrated in an extended position.
Figure 1:
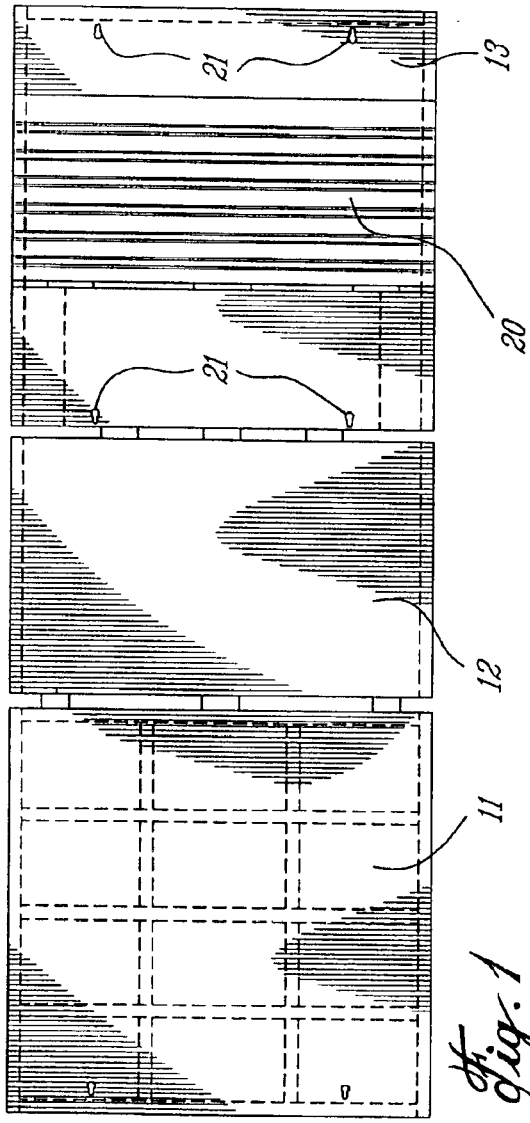
FIG. 1 is an example of an articulated bed support frame to which the mattress leg rest section of the present invention is secured.
Figure 2:
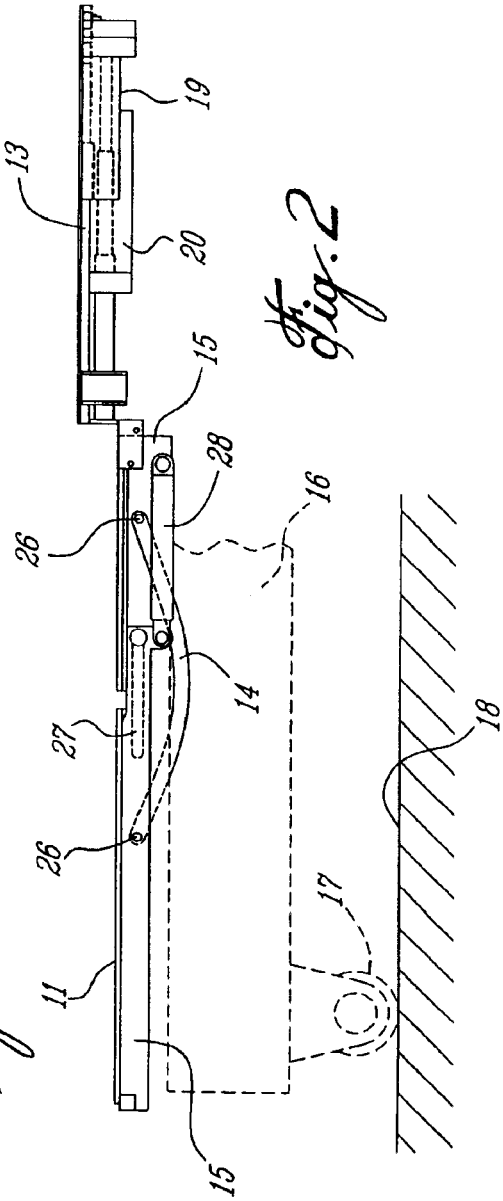
FIG. 2 is a side view of FIG. 1.

Referring now to the drawings and more particularly to FIGS. 1 to 3 there will be described the construction and operation of an articulatable bed support frame which is known in the prior art and to which the compressible mattress leg rest section of the present invention is secured. However, these support frames may be constructed differently provided they have a retractable leg rest section to which the compressible mattress leg rest section of the present invention can be secured to.

As hereinshown the articulated support frame 10 comprises a backrest support frame 11, a seat rest support frame 12, and a retractable leg rest support frame 13. These support frames 11, 12 and 13 are interconnected together through linkages 14, as better shown in FIG. 2 and to an attachment frame 15 which is in turn secured to an elevating frame 16 hereinshown in phantom line and having floor supports or casters 17 to support the bed on a floor support surface 18.

Figure 6:
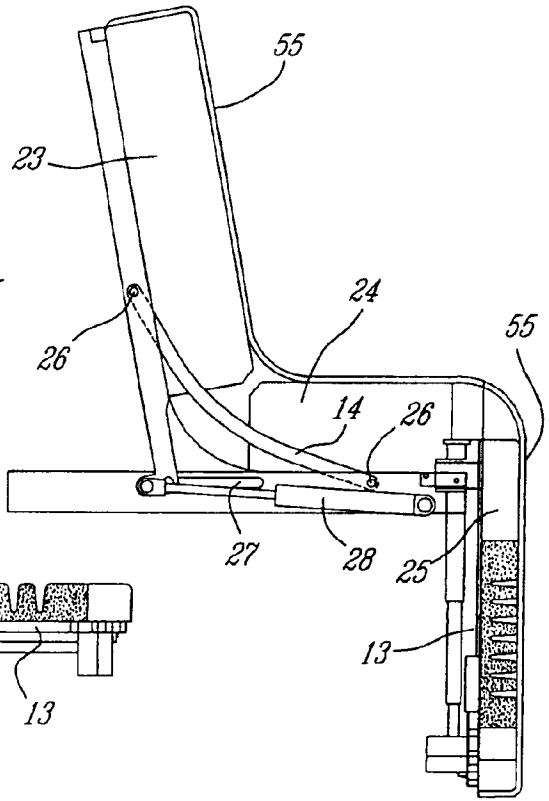
FIG. 6 is a side view showing the articulated bed disposed in a chair position.

The retractable leg rest support frame 13 has a sliding frame section 19 which slides over a stationary frame section 20 to adjust the length of the leg rest support frame 13. It is necessary to retract the sliding frame section 19 over the stationary frame section 20 to shorten the length of the retractable leg rest support frame when the support frame sections 11, 12 and 13 are articulated to a seating position as shown in FIG. 6. However, when the retractable leg rest section 13 is retracted to the position of FIG. 6, it is necessary to retract the sliding frame section 19 to shorten the length of the retractable leg rest section 13 in order for a patient initially lying on the bed to be brought to a sitting position and being able to disembark the chair if necessary.

As shown in FIGS. 1 and 3 the retractable leg rest support frame is provided with attachments 21 for fastening a compressible mattress thereto.

Figure 4:
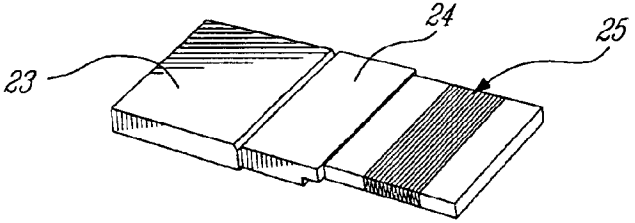
FIG. 4 is a perspective view showing the mattress sections incorporating the mattress leg rest section of the present invention.

Referring now to FIG. 4 there is illustrated the mattress sections which are securable to the frame sections. As hereinshown the mattress sections comprises a backrest mattress section 23, a seat rest mattress section 24 and the leg rest mattress section 25 of the present invention. These sections are secured to the support frames 11, 12 and 13 as illustrated in FIG. 5 with the backrest mattress section 23 secured to the backrest support frame 11, the seat rest mattress section 24 secured to the seat rest support frame 12 and the compressible leg rest mattress section 25 secured to the retractable support frame 13.

Figure 5:
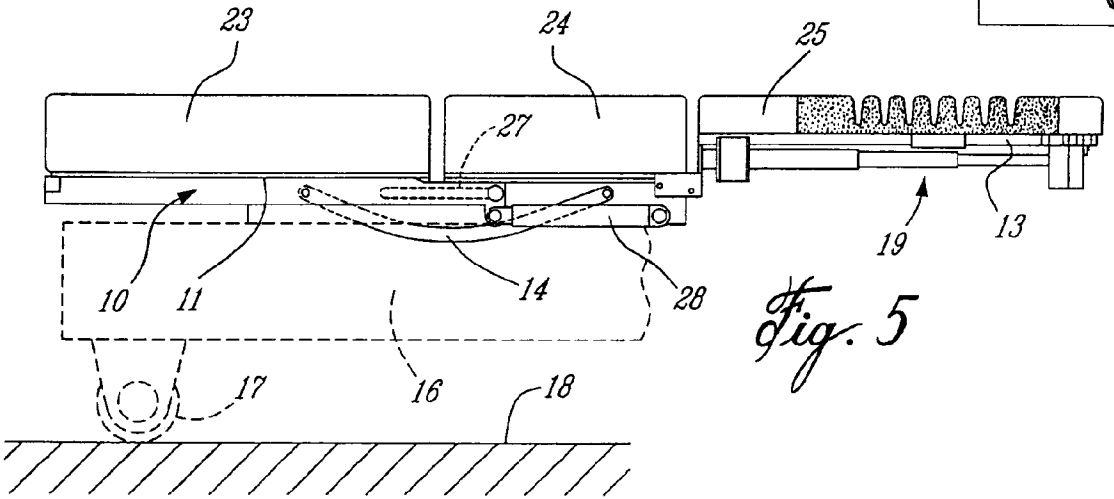
FIG. 5 is a side view showing the mattress sections of FIG. 4 secured to articulatable support frames.

As shown in FIGS. 5 and 6 the support frame sections are articulated by the linkages 14 and pivot connections such as identified by reference numerals 26 and guide track 27. A piston 28 which is hydraulically or pneumatically operated causes the frame sections to be displaced to desired positions. Similarly, the sliding frame section 19 of the retractable leg rest support frame 13 can be displaced by pneumatic, hydraulic or mechanical means not shown. The bed support frames can also be lowered with respect to the floor support surface 18 by hydraulic, pneumatic, electric or mechanical means not shown but obvious to a person skilled in the art.

Figure 7:
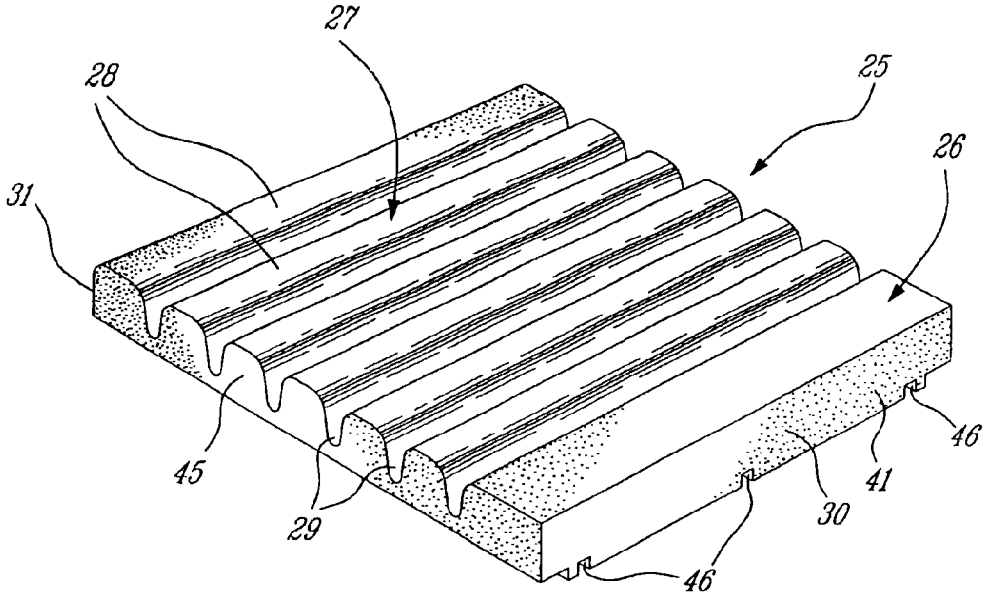
FIG. 7 is a perspective view illustrating the construction of the compressible foam piece section incorporated in the leg rest section of the mattress.

With reference now to FIGS. 7 to 10 there will be described the construction of the mattress leg rest section of the present invention. As shown in FIG. 7 the leg rest mattress section 25 is comprised of a high density soft foam material block 26 having an undulated surface section 27 defining peaks formations 28 separated by valleys formations 29. These peaks and valleys formations are dimensioned such that when the block is compressed from opposed retractable ends 30 and 34, the peaks formations 28 will be displaced closer to one another within the valleys formations whereby to compress the soft foam block 26 between its ends to shorten the block. As hereinshown the peaks and valleys are disposed in an alternating manner.

Figure 8:
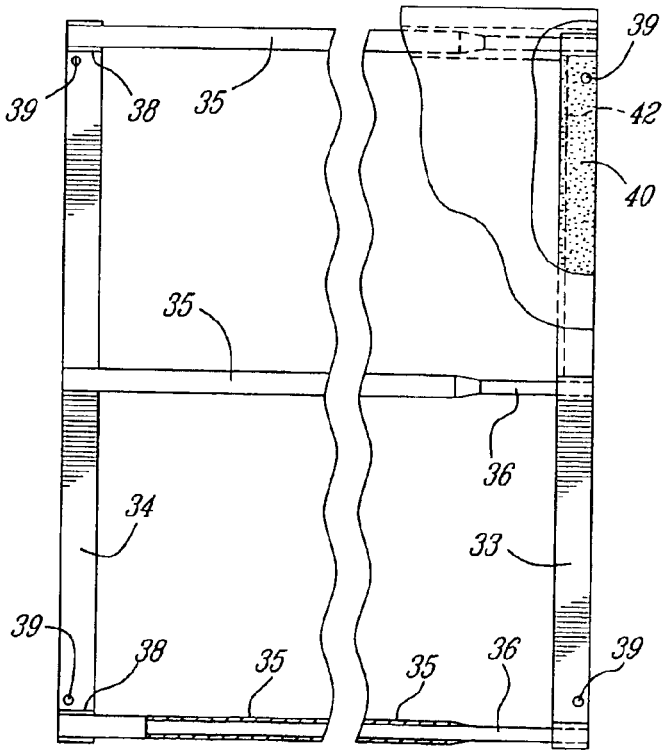
FIG. 8 is a plan view, partly fragmented illustrating the construction of the interconnecting telescoping members retained captive in the soft foam piece in a solid foam section under the undulated surface section thereof.
Figure 9:
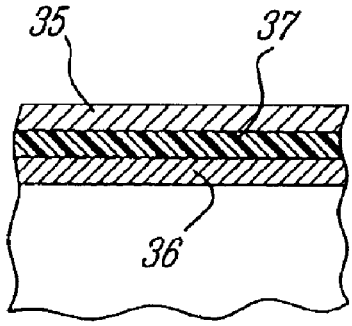
FIG. 9 is a fragmented section view showing the interconnection of the telescoping tubes with a bushing interposed between the tubes.

In order to compress the soft foam block there is provided compressible interconnecting means in the form of a pair of rigid connecting members 33 and 34 which are interconnected together by interconnecting telescoping means in the form of telescoping tubes 35 and 36. The tube 36 slides into tube 35 and the tubes are displaceable in translation with respect to one another to compress and decompress the soft foam block 30. As hereinshown the tubes are aluminum tubes and are separated by a nylon tubular bushing 37 as shown in FIG. 9 to prevent friction and wear of the tubes. There are 3 hollow telescoping aluminum tubes 35 as shown in FIG. 8 but it is to be understood that there could be 2 or more than 3 of these tubes. These telescoping tubes are connected to the rigid connecting members 33 and 34 by suitable means such as fasteners or welding attachments 38 and the tubes are disposed between transverse rigid connecting members as hereinshown. The rigid connecting members 33 and 34 are retained parallel to one another and have attachment means in the form of through bores 39 for connecting to the attachments 21 of the sliding frame section 19 and stationary frame section 20 of the retractable leg rest support frame 13. Fasteners, not shown, are used to interconnect the connecting members 33 to their respective attachments 21.

It is pointed out that the rigid connecting members 33 and 34 are secured to the connectable ends 31 and 30 respectively and this securement can be achieved in many ways. For example as shown in FIG. 8 opposed ends of the foam block 26 may be glued, such as shown at 40, to a flat top surface of these rigid connecting members. On the other hand, these rigid connecting members may be provided with a transverse vertical connecting flange 42 to abut the end walls 41 of the block and that could be glued to the lower portion of the end wall. Longitudinal channels or cavities 46 are also formed in the solid bottom section 45 of the block whereby to accommodate the telescoping tubes 35 therein. These telescoping tubes are retained captive in a respective one of the cavities 46 and the reason for this is to prevent buckling of the foam block when compressed. It is important that when the foam block is compressed that it is maintained in a substantially common horizontal plane in order to cause the peaks formations to compress against one another and deform, with the valleys allowing for the maximum desired compression, which is dependent on the length of displacement of the sliding frame section 19 of the retractable leg rest support frame 13. It is also pointed out that the connectable ends 30 at opposed ends of the soft foam block 26 may have solid sections of the high density soft foam.

Figure 10:
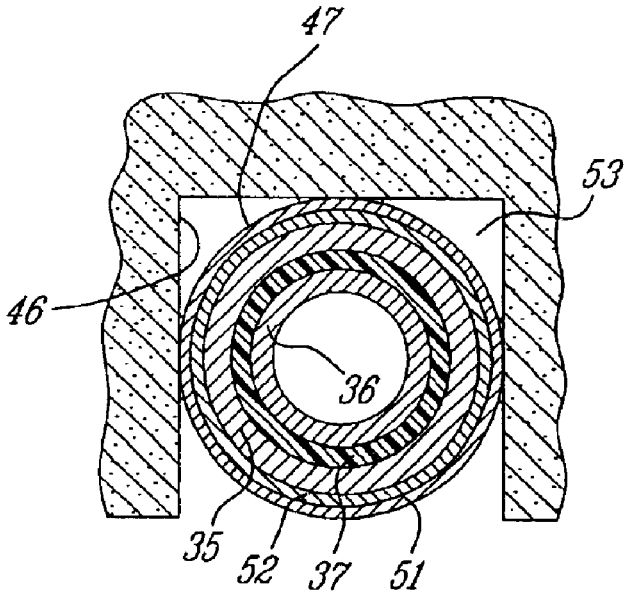
FIG. 10 is a fragmented cross-section view illustrating the construction of the restraining means which is constituted by a composite fabric material tube which is glued in elongated cavities formed along the underside of the compressible foam piece section.

With reference now to FIG. 10 there will be described the restraining means that retains the compressible material in a substantially uniform plane as it is compressed and decompressed. This restraining means is constituted by a fabric material tube 50 which is hereinshown as a double layer material tube having an outer neoprene layer 51 and an inner nylon layer 52 which are secured together such as by gluing or stitching to form the elongated material tube 50. The reason for the outer neoprene material is that such material has excellent adherence properties when glued to another surface. As hereinshown this tubular material is glued inside the channels 46 by the application of glue spots 47 within the channel. Glue spots may be provided under the peaks formations 28 and at the ends and the glue must permit the material tube 50 to also compress. When the fabric tube is glued the telescoping tubes are disposed therein whereby the tube 50 can retain its shape during the time the glue sets. Of course there may be sufficient glue to fill the interstices 53 within the channel under the peaks formations. The glue also needs to have flexibility during compression and decompression of the foam block 26. Therefore, it can be seen that the foam block is attached to the telescoping tubes 35 and the frames 33 and 34 through the fabric sleeve. The inner nylon sleeve 52 provides excellent frictional characteristics with the outer surface 35' of the outer tube 35.

As shown in FIG. 6 the leg rest mattress section 25 as well as the backrest section 23 and seat rest section 24 are all disposed within a single envelope or bed sheet 55 and during compression this envelope is squeezed within the valleys formations 29 of the leg rest mattress section 25. When decompressing, it is released. Accordingly, it is not necessary to have different envelopes for each of the mattress sections.

Although the articulated bed as hereinshown and described is primarily for hospital use it is also pointed out that the mattress leg support section of the present invention can be used on articulated beds not intended for hospital patients. For example, it could be secured to wheelchair structure of the type as shown in aforementioned U.S. Pat. No. 6,141,806 or other chair/bed designs and wherein a bed ridden person can convert his bed to a chair and displace himself on wheels which are actuated by the hands of the patient. The bed can also be disposed at various intermediate positions, from a seated position to a horizontal bed position, for purposes of relaxation or for any other purpose. Accordingly, it is not intended to limit the use of the mattress leg rest section as herein described.

It is within the ambit of the present invention to cover any obvious modifications of the embodiments described herein, provided such modifications fall within the scope of the appended claims.

I claim:

1. An articulated bed convertible to a chair position, said bed comprising a mattress formed of sections including a leg rest section, said mattress sections being secured to respective support frames, articulating linkage means to articulate said support frames, said mattress leg rest section being secured to a retractable support frame, means to support said support frames elevated from a floor surface, said leg rest section of said mattress having at least a compressible section thereof formed of compressible material, compressible interconnecting means to compress said compressible material to shorten the length of said compressible section, restraining means to restrain said compressible material as it is compressed and decompressed when said support frames are displaced from a horizontal position to an articulated chair position and vice versa, said compressible section is constituted by a high density soft foam piece material having an undulated surface section defining peaks and valleys formations dimensioned and positioned such that said compressible means can cause said peaks formations to be displaced closer to one another within said valleys formations to compress said soft foam piece, said compressible interconnecting means comprises a pair of rigid connecting members interconnected together by interconnecting telescoping means to cause guided displacement of a displaceable one of said rigid members relative to a stationary one of said rigid members, said displaceable one of said rigid members being connected to displacement means, said interconnecting telescoping means being constituted by at least a pair of telescoping interconnecting members secured between said rigid members, said telescoping interconnecting members being retained captive in said soft foam piece in a solid section of said foam niece under said undulated surface section.

2. An articulatable bed as claimed in claim 1 wherein said peaks and valleys formations are alternating peaks and v formations.

3. An articulatable bed as claimed in claim 1 wherein said telescoping interconnecting members are retained captive in respective elongated cavities formed in said soft foam piece under said undulated surface section.

4. An articulatable bed as claimed in claim 3 wherein said elongated cavities are elongated channels formed in a lower surface of said soft foam piece, said undulated surface section being formed in a top surface of said soft foam piece.

5. An articulatable bed as claimed in claim 4 wherein said soft foam piece is a rectangular block of Styrofoam material having a predetermined thickness.

6. An articulatable bed as claimed in claim 5 wherein said foam piece is a foam block secured to said rigid members at opposed ends thereof by glue.

7. An articulatable bed as claimed in claim 3 wherein said restraining means is constituted by a fabric material tube spot glued in each said elongated cavities, said telescoping interconnecting members extending in a respective fabric material tube, telescoping tubes secured between said pair of rigid members and extending transversely therebetween, said rigid members being disposed parallel to one another and having securement means for connection to a displaceable leg rest section support frame.

8. An articulatable bed as claimed in claim 7 wherein said fabric material tube comprises a double material tube having an outer Neoprene® layer for improved adherence, and an inner Nylon® layer to reduce friction with said telescoping interconnecting members.

9. An articulatable bed as claimed in claim 7 wherein said tubular members are hollow telescoping aluminum tubes, and a nylon bushing disposed between said tubes, therebeing three of said telescoping tubes secured between said pair of rigid members and extending transversely therebetween, said rigid members being disposed parallel to one another and having securement means for connection to a displaceable leg rest section support frame.

10. An articulatable bed as claimed in claim 9 wherein said displaceable leg rest section support frame has a stationary frame section and a sliding frame section constituting said displacement means, connecting means uppermost of said stationary frame section and lowermost of said sliding frame section, said rigid members being immovably connected to a respective one of said connecting means.

11. An articulatable bed as claimed in claim 10 wherein said securement means and connecting means are fastener receiving through bores, and fasteners for interconnecting said rigid members to said displaceable leg rest section support frame through said through bores.

12. An articulatable bed as claimed in claim 10 wherein said bottom displaceable frame section is secured to a displaceable device constituting said displacement means.

13. An articulatable bed as claimed in claim 12 wherein said displaceable device is one of an electric motor drive linkage, a pneumatic drive linkage, an hydraulic drive linkage or a manually operable drive linkage.

14. An articulatable bed as claimed in claim 1 wherein said mattress sections comprise a backrest section, a seat rest section and said leg rest section all said sections being disposed in a single envelope.

15. mattress as claimed in claim 14 wherein, said compressible interconnecting means comprises a pair of rigid connecting members interconnected together by interconnecting telescoping means to cause guided displacement of a displaceable one of said rigid members relative to a stationary one of said rigid members, said displaceable one of said rigid members being connected to displacement means.

16. A mattress as claimed in claim 15 wherein said soft foam piece is a rectangular block of Styrofoam material having a predetermined thickness.

17. A mattress as claimed in claim 16 wherein said peaks and valleys formations are curved peaks and valleys formations defining a wave cross-section.

18. An articulatable bed as claimed in claim 1 wherein said peaks and valleys formations are curved peaks and valleys formations defining a wave cross-section.

19. An articulatable bed as claimed in claim 1 wherein said bed is a hospital bed.

20. A mattress leg rest section for use with an articulated bed convertible to a chair position, said mattress leg rest section comprising at least a compressible section formed of compressible material and having an undulated surface section defining peaks and valleys formations dimensioned such as to be compressed by compressible interconnecting means to cause said peaks formations to be displaced closer to one another within said valleys formations to shorten said mattress leg rest section, said telescoping interconnecting members being retained captive in respective elongated cavities formed in said soft foam niece under said undulated surface section.

21. A mattress as claimed in claim 20 wherein said peaks and valleys formations are alternating peaks and valleys formations.

22. A mattress as claimed in claim 21 wherein said elongated cavities are elongated channels formed in a lower surface of said soft foam piece, said undulated surface section being formed in a top surface of said soft foam piece.

23. A mattress as claimed in claim 22 wherein said fabric material tube comprises a double material tube having an outer Neoprene® layer for improved adherence, and an inner Nylon® layer to reduce friction with said telescoping interconnecting members.

24. A mattress as claimed in claim 20 wherein said restraining means is constituted by a fabric material tube spot glued in each said elongated cavities, said telescoping interconnecting members extending in a respective fabric material tube, telescoping tubes secured between said pair of rigid members and extending transversely therebetween, said rigid members being disposed parallel to one another and having securement means for connection to a displaceable leg rest section support frame.

25. A mattress as claimed in claim 24 wherein said tubular members are hollow telescoping aluminum tubes, and a nylon bushing disposed between said tubes, therebeing three of said telescoping tubes secured between said pair of rigid members and extending transversely therebetween, said rigid members being disposed parallel to one another and having securement means for connection to a displaceable leg rest section support frame.

* * * * *